United States Patent [19]

Lee et al.

[11] Patent Number: 4,519,876

[45] Date of Patent: May 28, 1985

[54] ELECTROLYTIC DEPOSITION OF METALS ON LASER-CONDITIONED SURFACES

[75] Inventors: Chung H. Lee, Reading; John Fronduto, Waltham; Peter E. Oettinger, Acton, all of Mass.

[73] Assignee: Thermo Electron Corporation, Waltham, Mass.

[21] Appl. No.: 625,765

[22] Filed: Jun. 28, 1984

[51] Int. Cl.[3] ..... C25D 5/02

[52] U.S. Cl. ..... 204/15; 204/37.6; 204/DIG. 7

[58] Field of Search ..... 204/15, DIG. 7, 30, 204/37.6, 38 A

[56] References Cited

U.S. PATENT DOCUMENTS

| | | | |
|---|---|---|---|
| 3,506,545 | 4/1970 | Garwin | 357/65 |
| 3,506,779 | 4/1970 | Brown et al. | 358/297 |
| 3,560,258 | 2/1971 | Brisbane | 430/319 |
| 3,574,657 | 4/1971 | Burnett | 430/302 |
| 3,664,737 | 5/1972 | Lipp | 355/18 |
| 4,063,949 | 12/1977 | Uhlig et al. | 148/6.27 |
| 4,217,183 | 8/1980 | Melcher | 204/15 |
| 4,266,006 | 5/1981 | Uhlig et al. | 430/300 |
| 4,430,165 | 2/1984 | Inoue | 204/15 |
| 4,431,707 | 2/1984 | Burns | 204/30 |

OTHER PUBLICATIONS

A. K. Al-Sufi et al., "Laser Induced Copper Plating", J. Appl. Phys. 54 (6), Jun. 1983, pp. 3629-3631.

D. Banks, "Automation in Laser Platemaking", SPIE vol. 23 (1980), pp. 23-28.

Dunn, S. T., "Overview: Lasers Versus Photomaterials", SPIE vol. 223 (1980), pp. 42-49.

R. J. Prichard, "Computer to Plate: Raster Data Control for Lasers in Printing", Photonics Spectra, Jul. 1983, pp. 61-64.

*Primary Examiner*—Thomas Tufariello

*Attorney, Agent, or Firm*—Herbert E. Messenger

[57] ABSTRACT

An improved laser-based method of depositing a metal on an electrically insulated metallic substrate is disclosed. Selected areas of the insulated plate such as an anodized aluminum plate are irradiated with laser energy to fracture the anodized layer and expose underlying aluminum. The plate is immersed in a solution containing copper ions and negatively biased so that a thin layer of copper is electrolytically deposited in the selected areas to form copper features. The method is particularly suited to the rapid production of high quality, durable photographic printing plates with long shelf life.

15 Claims, 8 Drawing Figures

ELECTROLYTIC DEPOSITION OF METALS ON LASER-CONDITIONED SURFACES

BACKGROUND OF THE INVENTION

This invention relates in general to deposition of a metal by electrolytic means on selected regions of a substrate and in particular to pattern generation on anodized aluminum lithographic printing plates by means of laser conditioning of selected regions of the surfaces followed by electrolytic deposition of copper in these regions.

Recording information by the generation, or "writing", of precise patterns on lithographic printing plates is an important step in the production of newspapers and other printed materials. Thus there is considerable interest in developing techniques which reduce the time, material, and labor required to record lithographic printing plate patterns that are wear-resistant and have a long shelf life.

Conventional lithographic recording techniques consist of several steps which include forming a 1:1 negative of a paste up, or original copy, to be printed, developing the negative, vacuum contacting the negative onto a photosensitized plate, and directing light from a mercury vapor or metal halide lamp through the entire negative simultaneously, thereby exposing the photosensitive, coated plate. The plate must then be developed, as by removal of the unexposed photosensitive material. This method requires at least several minutes to complete and is both labor-and materials-intensive. Moreover, the resulting plates may lack the durability needed to print large numbers of copies, and/or the shelf life needed to permit reuse several months following the initial print run.

In certain segments of the printing industry laser imaging techniques have now been found preferable to conventional platemaking processes. A laser can image graphics or text onto either film or directly onto photosensitized plates. When used to expose film, the laser beam can be vector-or raster-scanned over the film, its trajectory controlled and its amplitude modulated by a computer. Such film exposure requires only a low power laser. However, the resultant negative must subsequently be used in a manner similar to that of conventional techniques to expose a photosensitized plate. With higher power lasers, the computercontrolled beam can image graphics or text directly onto a photosensitized plate surface. Direct laser plate imaging systems may include a low power laser scanner, such as a HeNe laser, which reads and electronically stores printed matter from the paste up, and a high power ultraviolet laser writing unit which exposes an ultraviolet photosensitive coating on a lithographic plate in accordance with information stored in a computer. Such direct laser imaging processes save considerable amounts of labor and time and also eliminate costly silver-based films used in conventional and laser-to-film platemaking. However, the high cost of these direct laser platemaking systems, their lower than desired speed of forming patterns on the lithographic plates, and the limited shelf life of plates made using photosensitive materials are drawbacks to these methods. Also, typical printing run lengths achievable with plates formed using laser imaging processes are limited by the durability and wear resistance of the ultraviolet-sensitive, polymeric materials used.

Accordingly, it is a general object of the present invention to provide an improved method of depositing a metal on spatially selected areas of an electrically insulating coated metal substrate.

Another object of the invention is to provide a method of laser-conditioning spatially selected areas of an electrically insulating coating on a metal substrate so that electrolytic processes will deposit metal in these areas.

Particular objects of the invention are to provide a method of producing printing plates whose print features are durable and capable of long print runs and have a long shelf life, and to provide a method of recording on lithographic printing plates which, in addition to the above-stated objects, is more rapid, labor saving, and less material intensive than existing methods.

SUMMARY OF THE INVENTION

The invention is directed to a method of rapidly coating spatially selected regions of an electrically insulated substrate such as anodized aluminum with a metal film, such as copper. The combination of copper deposited on an anodized aluminum plate is particularly useful in the formation of high quality, durable printing plates. According to this particular embodiment of the invention, selected regions of the substrate, such as areas on which printing features or characters are to be deposited, are irradiated with laser energy sufficient to fracture the anodized surface layer and expose underlying aluminum. A thin layer of copper is then electrolytically deposited in the selected areas to form copper printing features. In contrast to conventional methods of direct laser printing on plates, this invention eliminates the need for a special photosensitive coating on the anodized surface layer.

In a preferred embodiment of the invention, an aluminum plate having a porous, dye-filled anodized surface layer of aluminum oxide is irradiated in air by a laser such as a beam-modulated, continuous wave carbon dioxide or Nd:YAG laser. The focussed laser beam shrinks the upper portion of the anodized layer, indenting it and thermally fracturing the anodized layer. This exposes the underlying aluminum through small cracks in areas of the plate to which laser energy is applied. The laser beam and/or the plate is steered to irradiate areas corresponding to the printing features to be produced. The plate is then immersed in an electrolytic bath such as copper sulfate and sulfuric acid with the plate negatively biased, and a layer of copper of desired thickness is electrolytically deposited on the exposed aluminum to produce copper printing features.

According to an alternate embodiment of the invention an unexposed plate, electrically insulated by a coating, preferably of anodized aluminum, is immersed in an electrolytic bath such as copper sulfate and sulfuric acid, and the plate, while negatively biased, is irradiated by a suitable laser. The laser beam is steered in a predetermined pattern and copper is electrolytically deposited in the areas whose anodized layer has been fractured by the laser to expose underlying aluminum. In this alternate embodiment deposition of printing features in a specific area starts to occur immediately following laser irradiation, and since the irradiated plate is not in contact with air, there is no risk of the formation on the exposed aluminum areas of an electrically resistive film, such as a metal oxide, which could modify deposition of the copper printing features. This embodiment is, however, limited to laser wavelengths which can be transmitted through the electrolytic solution. Also, because the laser beam diffracts in passing through the electrolyte, the resolution of copper features deposited in this manner may be lower than obtainable in the earlier-described method wherein the plate is irradiated outside of, and prior to its immersion into, the electrolytic bath.

In either of the above-described techniques, appropriately-colored dyes are embedded in the pores of the anodized layer of the plate to enhance the absorption of the laser beam and thereby increase its efficiency in fracturing the surface. Also, the laser may be modulated, as by mechanical chopping, to produce dots rather than continuous lines as printing features, such dots being necessary in the printing of half tones.

The copper printing features on an anodized aluminum background produced according to the above-described methods provide an excellent combination for high quality, wear resistant printing plates with long shelf life. Preferably these features are fabricated so as to be indented or recessed below the surface of the surrounding anodized layer by, for example, regulating laser power and steering rate such that a portion of the surface layer is shrunk or removed and regulating electrolytic deposition such that the copper layer deposited does not completely fill the recess. The resulting recessed features will more readily retain ink and suffer less wear during printing, thereby providing even better print quality and longer plate life.

DESCRIPTION OF PREFERRED EMBODIMENTS

This invention relates in general to a method of rapidly conditioning an electrically insulated surface of a metal substrate by a laser, and electrolytically depositing a metal coating on the conditioned areas. In a preferred embodiment the conditioning laser is an infrared laser, the deposited metal is copper, and the electrically insulated metallic substrate is anodized aluminum. This embodiment can be used to form printed features, graphics and text, on a printing plate used, for example, in offset planographic printing.

Figure 1A:
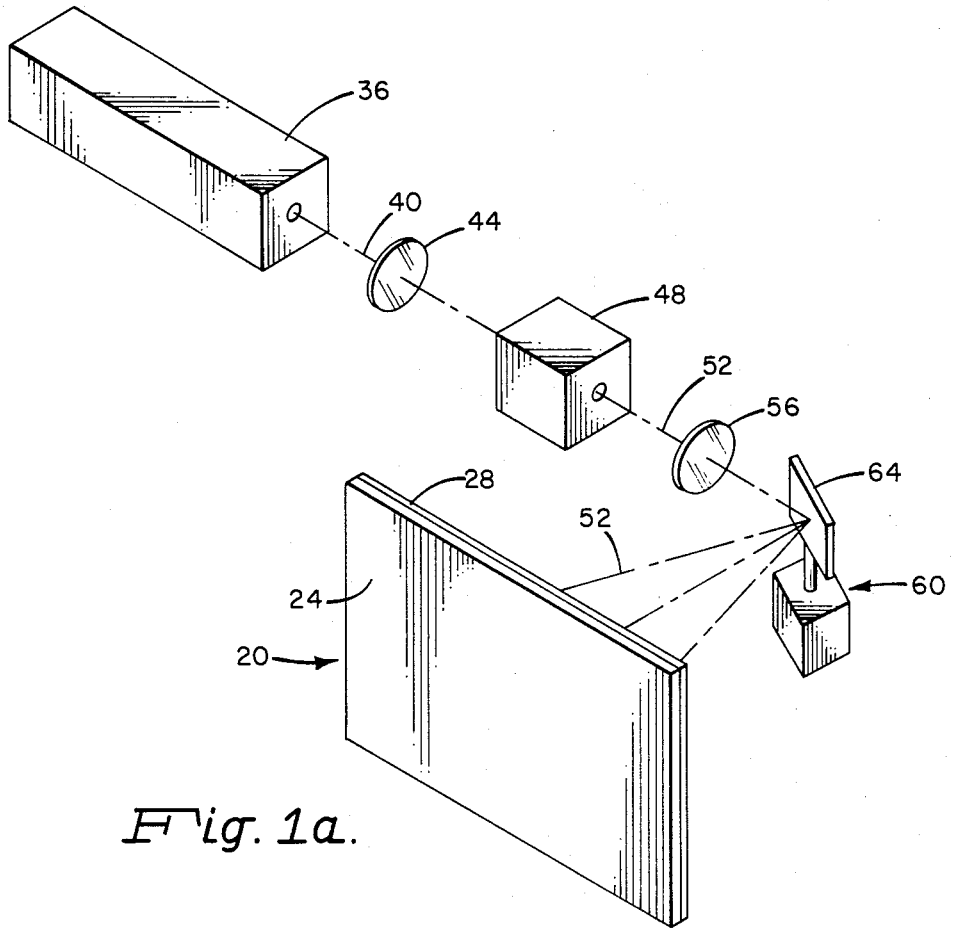
FIG. 1 is a schematic illustration of one preferred set of components of a plate-making system suitable for practicing the process of the invention.

FIG. 1 shows in schematic form a preferred set of components and the manner in which they are utilized to produce metal coatings on selected areas of a metal substrate according to one form of the invention. First, a plate 20 is prepared by coating an aluminum base 24 with a film of aluminum oxide 28 about 5 micrometers to 25 micrometers thick using a standard anodizing process such as sulfuric acid anodization. During the latter stages of this process a dye of selected color such as a black or gray dye is embedded in the pores of the aluminum oxide coating and the dye is sealed as by treating the surface of the anodized layer with nickel acetate. As is indicated in FIG. 1*a*, the plate 20 is conditioned by exposure to the beam 32 of a laser 36 which may be selected from a wide variety of commercially available units and may emit any wavelength from the ultraviolet to the infrared. The laser currently preferred from the standpoint of performance and economy is either a Nd:YAG laser or a carbon dioxide laser emitting in the infrared at, respectively, 1.06 micrometers and 10.6 micrometers. Continuous wave 100 W (watt) Nd:YAG and 400 W carbon dioxide lasers are readily available, whereas the strongest available continuous wave argon ion visible laser is limited to about 20 W. The additional power of the infrared lasers allows a faster writing speed, or a shorter illumination time, of the laser beam 32 on the anodized surface 28 than would be attainable with argon ion visible lasers or the ultraviolet lasers typically used to expose photosensitive materials in conventional platemaking processes. The formation, or writing, of text or graphics features on this anodized suface 28 is performed by focussing the output beam 40 of the laser 36 by means of a lens 44 through an acousto optic modulator 48 in order to amplitude modulate the radiation and convert continuous emission of the beam 40 to a pulsed beam 52. These pulses of radiation are passed through and focussed by a second lens 56, reflect from a mirrored surface such as a galvanometrically-controlled mirror 64 of an optical scanner 60, and are directed onto the anodized surface 28. The optical scanner 60 sweeps the pulses of radiation across the anodized surface 28. In an alternate configuration the optical scanner 60 may comprise a rapidly rotating polygon (not shown) containing a number of mirrored facets instead of the galvanometrically-controlled mirror 64. With a second galvanometrically-controlled mirror (not shown) placed in close proximity to the mirror 64 and independently regulated, the pulsed beam 56 can be positioned at any point on the stationary anodized surface 28. This configuration lends itself to vector scanning of the printing plate 20 by the laser beam 32. If a rotating polygon is used to scan the beam 32 across the anodized surface 28 then the printing plate 20 is mounted on a drum and rotated in a direction perpendicular to the scanning direction of the beam 52. In this mode of illumination of the plate 20 the anodized surface 28 would be raster-scanned. For either the vector- or raster-mode of scanning, the pulsed beam will form a series of resolvable dots on the anodized surface 28. These features will produce the required half tones for printing graphics and can be used as well for printing text. The highest resolution, or the smallest dot size which can be recorded for the half tone image, will determine the number of gray levels which can be printed, and, thus, the visual fidelity of the image.

The minimum dot size which can be printed is determined by the diffraction limited focus of the laser beam 52. For similar beam widths and focal lengths of the focussing lens, the diameter of the spot will be proportional to the lasing wavelength. Consequently, the minimum spot size of the carbon dioxide laser emission would be expected to be about twenty times as large as that of the argon ion laser, and about ten times that of the Nd:YAG laser. However, in the experiments conducted so far the widths of the deposited copper lines have not shown this trend. A possible explanation is that the lateral extent of the laser induced cracks which form in the anodized surface depend not only on the lasing wavelength, beam width, and lens focal length, but also on the laser power, the beam scanning speed, the radiation absorption depth in the anodized layer, and the electrolytic bath parameters and plate immersion time. These additional parameters influence the stress concentration built up in the anodized layer, and, consequently, the extent of fractures induced by the laser beam in this surface film and the lateral distance from the crack that the copper will coat. When a carbon dioxide laser (Model No. 81-5500-TG-T manufactured by California Laser Corporation of San Marcos, Calif.), with a 10 cm focussing lens was operated at a wavelength of about 10.6 micrometers, a radiation spot size of about 400 micrometers was formed. At a scanning speed of 20 cm per second the 4 Watt output of this laser caused the formation of cracks, which when coated with copper during immersion of the plate for 30 seconds in an electrolytic bath, produced copper lines about 30 micrometers wide.

Figure 1B:
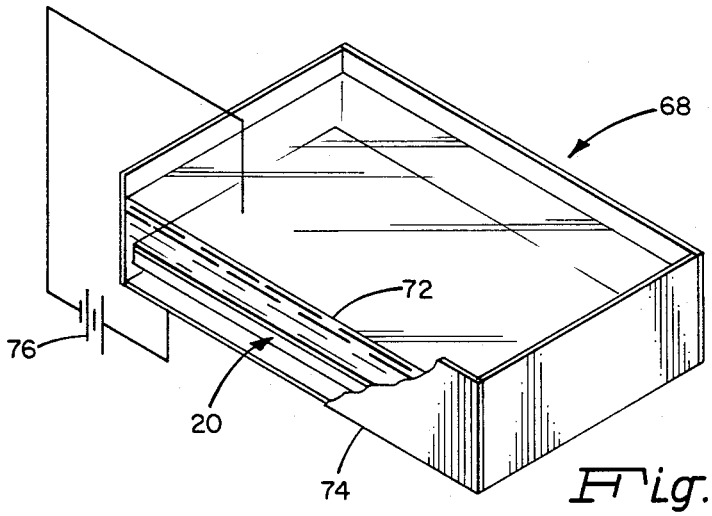

Immersion of the plate into an electrolytic bath is the last part of the process. As indicated in FIG. 1*b*, the plate 20, after exposure to the scanning laser beam 36, is immersed in an electrolytic tank 68 containing a mixture of an electrolyte 72 composed of copper sulfate ($CuSO_4$) and sulfuric acid ($H_2SO_4$). A voltage applied between an electrode in the tank (which could comprise the tank walls 74) and the plate 20 by an appropriate dc power supply 76, so that the plate 20 is biased negatively, will send a current between the electrodes 20 and 74 and through the electrolyte 72. Copper ions will be attracted to the aluminum base 24 of the plate 20 exposed to the electrolyte 72 through the cracks formed by the scanning laser beam 36. The copper will fill the cracks in the anodized layer 28 and then continue to deposit over the surface of the anodized layer away from the cracks. The extent of this coating from the cracks is determined by the composition of the electrolytic bath in the electrolytic tank 68, the current passing through the electrolyte 72 and the time the plate 20 is immersed in this electrolyte 72.

Figure 2A:
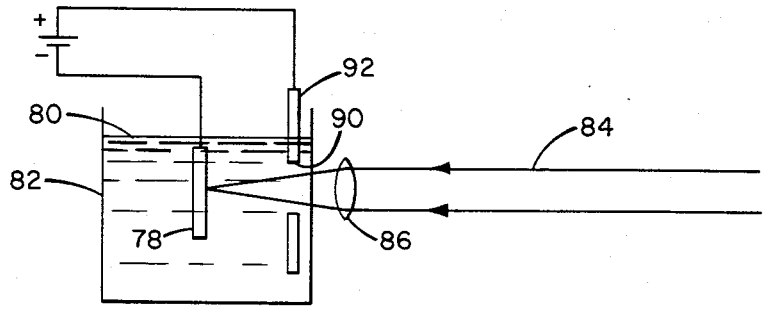
FIG. 2 is a schematic illustration of the components of two alternate configurations of a laser-conditioning-/electrolytic-deposition system which may be used to deposit metal on selected spatial areas of an electrically insulated metallic substrate according to the invention.
Figure 2B:
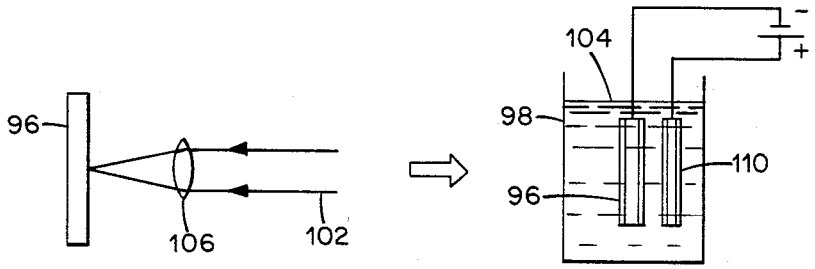

The method of laser-induced selective plating of the invention therefore consists of two distinct processes: laser irradiation of specific areas on a surface, followed by electrolytic deposition of a metal on those areas. FIG. 2 shows two configurations for practicing the method. In the form illustrated in FIG. 2*a* an unexposed cathode 78 to be plated is submerged within electrolyte 80 in a tank 82 and a laser beam is focussed by a lens 86 and is directed through a hole 90 in an anode 92 onto the areas of the cathode 78 to be plated. (As described above, the beam 82 may be scanned over predetermined portions of the cathode 78, in addition to which the cathode 78 may be moved to expose selected areas to the laser beam 82). Electrolytic plating occurs immediately after irradiation by the laser beam 84 and without the cathode being exposed to atmospheric conditions between these two processes. In an alternate configuration shown in FIG. 2*b*, a plate 96 is positioned outside an electrolytic tank 98 and irradiated by a laser beam 102 focussed onto the plate 96 by a lens 106. Subsequently, the plate 96 is immersed in the electrolytic bath 104 and metal is electrolytically deposited on the laser exposed surface area as current passes through electrolyte 104 between an anode 110 and the plate 94.

The configuration shown in FIG. 2*a* has the advantage that the plate 78 is not exposed to any environment other than the electrolytic bath 80 after laser irradiation of its surface. Such exposure to, say, the atmosphere, as in the configuration shown in FIG. 2*b*, could result in formation of a metallic oxide film on the bare metal surface underlying the laser-induced cracks in the anodized surface layer. Formation of a sufficiently thick electrically insulating oxide layer would influence the electrolytic reaction and adversely affect deposition of the metal coating in the laser irradiated areas. One disadvantage of the configuration shown in FIG. 2*a*, however, is that the laser beam 84 in passing through the electrolyte 80 and heating this fluid may suffer diffraction, an effect which is maximized by thermally induced changes in the refractive index of the electrolyte 80 at the focus of the beam 84 on the surface of the plate 78. Such diffraction will defocus the beam and increase the image size, thereby reducing the resolution of metallic features electrolytically deposited on the surface of the plate 78. Another disadvantage of irradiating the plate 78 while it is submerged in the electrolyte is that only lasers emitting at wavelengths which are transmitted by the electrolyte can be used. Separating the processes, as shown in FIG. 2*b*, eliminates these beam diffraction and transmission problems but, as previously mentioned, introduces the possibility of oxide formation on the metal in the cracks formed by the laser irradiation. In the experiments conducted to date with copper deposition on anodized aluminum any oxide formed during periods of up to one hour exposure of the plate 96 to air at atmospheric pressure, between laser irradiation and subsequent electrolytic copper deposition, did not significantly affect the electrolytic process. In such separated processes it may, therefore, be possible to store the laser irradiated plate 96 for considerable time before depositing the cooper. Laser "writing" on these surfaces and their electrolytic "development" can, thus, be separated spatially and temporally.

Figure 3:
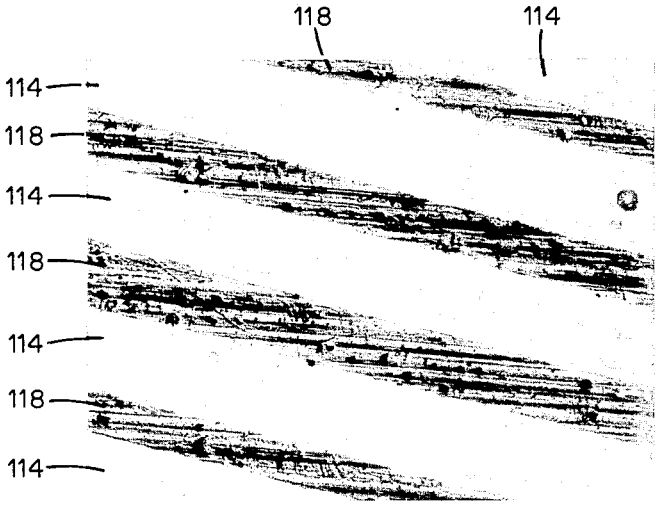
FIG. 3 is a photomicrograph of a portion of a substrate containing copper lines deposited on an anodized aluminum plate according to the process of the invention.
Figure 4A:
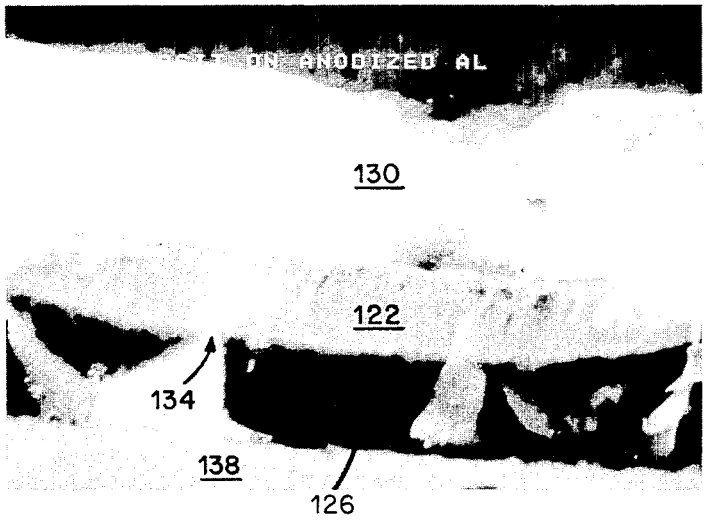
FIG. 4 is a sectional view of a copper line deposit illustrating the zone in the anodized surface affected by the laser radiation, the cracks produced in the anodized layer, and the regions of copper deposition.
Figure 4B:
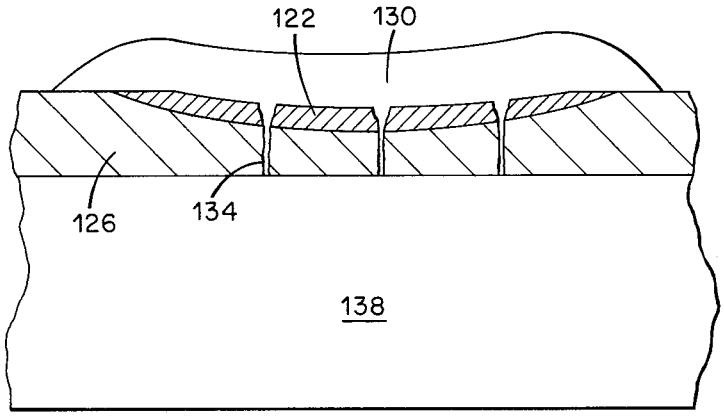

A series of copper lines 114 electrolytically deposited on an anodized surface subsequent to irradiation in air of the areas corresponding to these lines by a carbon dioxide laser beam is shown in the photomicrograph of FIG. 3. The copper lines 114 are about 33 micrometers wide and the uncoated anodized strips 118 between the lines are about 21 micrometers wide. The structure of a deposited feature is illustrated by a photomicrograph of a cross-section of a copper line (FIG. 4*a*) and by the sketch of the cross-section set forth as FIG. 4*b*. These show a laser-modified zone 122 in the anodized layer 126 and a copper deposit 130 about 14 micrometers thick overlying the laser-modified zone 122. The significance of the zone 122 with respect to the subsequent copper deposition is not yet understood, but some removal or shrinkage of the anodized layer 126 appears to occur. Laser-induced cracks 134 in the zone 122 and in the underlying unmodified anodized layer 126 form an electrical path connecting the aluminum base 138 to copper ions in the electrolytic bath to allow the electrolytic deposition of copper first in the cracks 134 and then over the laser-modified zone in the anodized layer 126. The thickness of the deposited copper lines varies with the characteristics of the electrolytic bath, the current passing through the electrolyte, and the amount of time the plate is immersed in the electrolyte. Uniform 2 micrometers thick copper deposition has been obtained across lines 120 micrometers wide.

Figure 5:
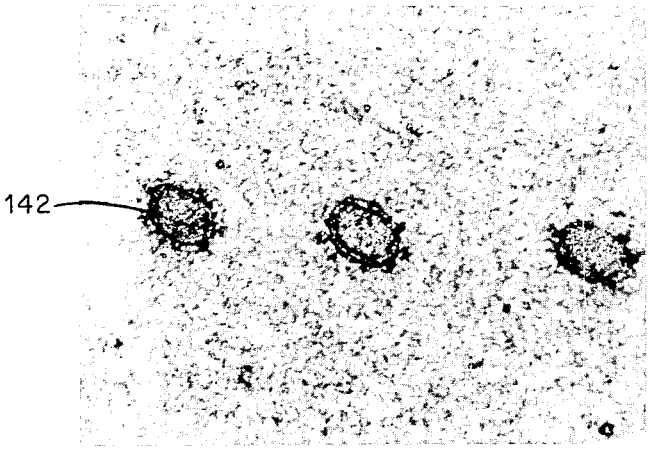
FIG. 5 is a photomicrograph of a portion of a substrate containing copper dots deposited on an anodized aluminum plate according to the process of the invention.

In order to be applicable to the printing of half tones, the invention must be able to form resolvable copper-coated dots, not just continuous lines. FIG. 5 is a photomicrograph showing the results of electrolytically depositing copper on laser irradiated spots formed by mechanically chopping a continuous beam from an argon ion laser operated at a wavelength of 488 nanometers and projecting the focussed radiation pulses on different spatial locations of an anodized aluminum surface. As can be seen, copper deposits 142 having a diameter of about 60 micrometers were produced, but only on the irradiated spots. This indicates that the cracks which are formed by the laser in the anodized layer do not migrate significantly outside the region of illumination.

Experiments were conducted on sealed black-dyed and gray-dyed anodized aluminum test plates irradiated in air at atmospheric conditions with either a focussed argon ion or carbon dioxide laser beam. The test plates were fabricated of aluminum alloy 5052 and were anodized by Light Metal Platers, Inc. of Waltham, Mass. using a standard sulfuric acid anodizing process. The thickness of the anodized layers ranged from about 7 to 25 micrometers. Best results were obtained on black-dyed plates having an anodization thickness of about 7 micrometers irradiated by the carbon dioxide laser. With a laser output power of 4 W, a 35 micrometer wide line was exposed at a laser beam scanning speed of approximately 15 centimeters per second. This line consisted of a zone extending about half way down the anodized layer into the recess formed by the apparent shrinkage and/or removal of this layer (the "shrinkage" possibly due to thermal evaporation of the dye within the pores and compression of the anodized material in this region). A number of thin (less than 1 micrometer) cracks were formed through the anodized layer. These cracks followed the direction of the scanning laser beam and extended down to the base aluminum. Such fracturing is thought to be caused by laser-induced thermal gradients in the aluminum oxide layer which cause mechanical stressing of this material. After the anodized samples were irradiated by the laser in air at atmospheric conditions, they were (within 60 minutes) immersed in an electrolytic solution containing 0.5 M $CuSO_4$ and 2 M $H_2SO_4$. With a negative voltage of 0.5 V on the aluminum base material approximately 100 mA of current was drawn. Copper deposits having a thickness of several micrometers were achieved after about 30 seconds of electrolytic reaction.

What is claimed is:

1. A method of depositing a metal on spatially selected regions of a workpiece comprising the following steps in the order given:

providing a workpiece having an electrically conductive substrate and an electrically insulative surface layer, irradiating the surface layer in said selected regions of said workpiece with laser energy to fracture portions of said surface layer in said regions, thereby providing in said regions a path to the substrate along which electric current may flow upon immersion of the workpiece into an electrolyte; and immersing said workpiece in an electrolytic plating bath and applying a negative electrical bias to said substrate to electrolytically deposit a coating of said metal onto said selected regions.

2. A method as in claim 1 wherein said irradiation step reduces the thickness of the surface layer in said selected regions and wherein the amount of metal applied to said regions in said deposition step is controlled such that the top of said metal coating in said selected regions is recessed relative to the top of the non-irradiated portions of said surface layer.

3. A method as in claim 1 wherein said metal is copper and said workpiece is an anodized aluminum plate.

4. A method as in claim 3 wherein said irradiating step includes rapidly scanning said workpiece with a pulsed beam of laser energy to fracture portions of said anodized surface layer in a multiplicity of selected regions corresponding to spatially separated areas where printing features are desired and wherein in said deposition step copper is deposited on each of said selected regions to produce said printing features.

5. A method as in claim 3 wherein said irradiating step includes scanning said plate at a speed of at least 15–20 centimeters per second with a laser beam.

6. A method as in claim 5 wherein said anodized layer consists of porous aluminum oxide less than about 25 micrometers in thickness and having pores containing a colored dye.

7. A method as in claim 4 wherein said printing features comprise a multiplicity of resolvable copper-coated dots.

8. A method of producing copper printing features on a plate comprising the following steps in the order given:

providing an aluminum plate having an electrically insulative anodized surface layer;

in an atmospheric, vacuum, or inert gas environment, irradiating spatially selected regions of said surface layer on which printing features are to be produced with a laser beam of energy sufficient to fracture portions of said surface layer of aluminum oxide in said regions; and immersing said plate in an electrolytic plating bath and applying a negative electrical bias to said plate to electrolytically deposit a thin coating of copper in said regions to produce copper printing features on said plate.

9. A method as in claim 8 wherein said irradiating step includes rapidly scanning said plate with a pulsed beam of laser energy to fracture portions of said surface layer in a multiplicity of dot-like regions.

10. A method as in claim 8 wherein said irradiation step reduces the thickness of the surface layer in said selected regions and wherein said electrolytic deposition step includes controlling the amount of copper applied in said regions such that the top of said copper coating in said printing features is recessed relative to the top of the non-irradiated portions of said surface layer.

11. A method as in claim 8 wherein said anodized layer of aluminum oxide consists essentially of porous aluminum oxide having pores filled with a colored dye and the surface of said anodized layer is sealed to contain the dye in said pores.

12. A method as in claim 8 wherein said deposition step comprises depositing in said regions a copper layer having a thickness of about 2 to 10 micrometers.

13. A method as in claim 8 wherein said electrolytic deposition is completed in a time interval of less than about 30 seconds.

14. A method as in claim 8 wherein said irradiating step is performed in an atmospheric environment.

15. A method of producing copper printing features on a plate comprising the following steps:

providing an aluminum plate having an electrically insulative, anodized surface layer;

immersing said plate in an electrolyte containing copper ions;

irradiating selected regions of said surface layer on which copper printing features are to be produced with a laser beam of energy sufficient to fracture portions of said surface layer in said selected regions; and immersing said plate in an electrolytic plating bath and applying a negative electrical bias to said plate to electrolytically deposit a thin coating of copper in said regions to produce copper printing features on said plate.

* * * * *